US007448693B2

(12) United States Patent
Kwon et al.

(10) Patent No.: US 7,448,693 B2
(45) Date of Patent: Nov. 11, 2008

(54) TOOTHBRUSH HAVING NEEDLE-SHAPED BRISTLE TAPERED AT ONE END AND MANUFACTURING METHOD THEREOF

(76) Inventors: Young-Jun Kwon, 4-7 Yadang-ri, Gyoha-eup, Paju, Gyunggi-do (KR) 413-830; Sung-Wook Kwon, 201-7 Heukseok-dong, Dongjak-gu, Seoul (KR) 156-861

( * ) Notice: Subject to any disclaimer, the term of this patent is extended or adjusted under 35 U.S.C. 154(b) by 0 days.

(21) Appl. No.: 11/710,920

(22) Filed: Feb. 27, 2007

(65) Prior Publication Data

US 2007/0170772 A1 Jul. 26, 2007

Related U.S. Application Data

(62) Division of application No. 10/627,913, filed on Jul. 28, 2003, now abandoned.

(30) Foreign Application Priority Data

Dec. 3, 2002 (KR) ..... 10-2002-76349

(51) Int. Cl.
*A46D 3/04* (2006.01)

(52) U.S. Cl. ..... 300/21

(58) Field of Classification Search ..... 300/21
See application file for complete search history.

(56) References Cited

U.S. PATENT DOCUMENTS

| | | | | |
|---|---|---|---|---|
| 1,413,211 | A * | 4/1922 | Albright, Jr. | 300/21 |
| 5,176,427 | A | 1/1993 | Weihrauch | |
| 5,350,219 | A | 9/1994 | Shou-Jen | |
| 5,390,984 | A | 2/1995 | Boucherie et al. | |
| 5,609,890 | A | 3/1997 | Boucherie | |
| 6,290,302 | B1 | 9/2001 | Boucherie | |
| 6,290,303 | B1 * | 9/2001 | Boucherie | 300/5 |
| 6,764,142 | B2 | 7/2004 | Kwon | |
| 6,792,642 | B2 | 9/2004 | Wagstaff | |
| 2003/0132661 | A1 * | 7/2003 | Sato et al. | 300/4 |

OTHER PUBLICATIONS

Office Action from parent application dated Jul. 19, 2006.
Office Action from parent application dated Nov. 15, 2006.
Office Action from parent application dated Apr. 4, 2007.
Office Action from parent application dated Oct. 4, 2007.

* cited by examiner

*Primary Examiner*—Randall Chin
(74) *Attorney, Agent, or Firm*—Lowe Hauptman Ham & Berner, LLP

(57) ABSTRACT

A toothbrush tufted with needle-shaped bristles. The bristles are formed of polyester resin. The bristles are 0.1 to 0.2 mm thick before tapering, 13 to 18 mm long, tapered 4 to 8 mm only on one end with a tapered tip thickness of 0.01 to 0.08 mm, and planted to be 7 to 13 mm high in the toothbrush.

4 Claims, 9 Drawing Sheets

PRIOR ART

PRIOR ART

TOOTHBRUSH HAVING NEEDLE-SHAPED BRISTLE TAPERED AT ONE END AND MANUFACTURING METHOD THEREOF

CROSS REFERENCE TO RELATED APPLCIATION

This application is a divisional of U.S. Ser. No. 10/627,913, filed on Jul. 28, 2003 now abandoned. This application, in its entirety, is incorporated herein by reference.

PRIORITY

This application claims priority under 35 U.S.C. § 119 to an application entitled "Toothbrush Having Needle-Shaped Bristle Tapered at One End" filed in the Korean Intellectual Property Office on Dec. 3, 2002 and assigned Serial No. 2002-76349, the contents of which are incorporated herein by reference.

BACKGROUND OF THE INVENTION

1. Field of the Invention

The present invention relates generally to a toothbrush having needle-shaped bristle, and in particular, to a toothbrush tufted with 13 to 18 mm long needle-shaped bristles tapered only on one end, and a manufacturing method thereof.

2. Description of the Related Art

Since the introduction of a toothbrush tufted with tapered bristles for effective plaque removal and prevention of damage to gums during teeth brushing, its verified effectiveness has recently made this toothbrush popular.

For fabrication of such a traditional toothbrush, 28 to 33 mm long bristles, which are needle-shaped on one end t and non-needle-shaped on the other end n, are folded over such that the needle-shaped portion is longer than the non-needle-shaped portion, as illustrated in FIGS. 1A and 1B. The folded portions are picked up by means of a cut wire and fixedly inserted into fixing holes in the head of the toothbrush. The toothbrush manufacturing method is disclosed in Japanese Patent Open-Laid No. Sho 61-10495.

As illustrated in FIG. 2, another traditional toothbrush is made by folding needle-shaped bristles, which are 28 to 33 mm long and tapered 4 to 8 mm on both ends, in two equal halves and planting them in the above-described manner. This toothbrush manufacturing technique is disclosed in Japanese Patent Open-Laid No. Hei 5-15834.

In Korea Patent No. 311360, the present inventor disclosed a toothbrush tufted with ordinary bristles tapered on both ends and at least one 1 to 10 mm longer bristle 62 of the same shape.

The above techniques, though they have their own benefits and drawbacks, commonly boast excellent plaque removal and improved health of gums.

However, they suffer from the same shortcomings of complex manufacturing, high inferior goods rate, and thus high production cost, for the following reasons.

(1) In order to shape ordinary polyester bristles into needles, the tips of the bristles are treated with a chemical such as caustic soda or sulphuric acid. During this process, the total length and tapered length of the bristles are difficult to control, thereby resulting in many inferior bristles. (2) In the case of a today's popular needle-shaped toothbrush tufted with bristles tapered on both ends, both tips of the bristles are treated in the above-described manner, for needle shaping. Even if one tip of a bristle is successfully tapered, the failure of the other tip leads to the whole failure of the bristle. (3) There are no appropriate applications for utilizing bristles having wrong lengths.

Besides, the traditional toothbrush bristles are planted in simple patterns and not tightly fixed, as illustrated in FIG. 4. As a result, the bristles often fall out of the brushes. The cause is identified that the bristles are folded by half, picked up with a wire, and pushed into fixing holes 10 by inserting the wire itself.

SUMMARY OF THE INVENTION

It is, therefore, an object of the present invention to provide a toothbrush tufted with needle-shaped bristles, which is manufactured in a simplified process at a diminished failure rate.

It is another object of the present invention to provide a method of utilizing bristles having wrong lengths for manufacture of a toothbrush.

It is a further object of the present invention to provide a method of fixing bristles more tightly in a toothbrush.

It is still another object of the present invention to provide a method of freely designing a bristle planting pattern and adjusting the number of bristles for a toothbrush.

The above objects are achieved by a toothbrush tufted with needle-shaped bristles. The bristles are formed of polyester resin. The bristles are 0.1 to 0.2 mm thick before tapering, 13 to 18 mm long, tapered 4 to 8 mm only on one end with a tapered tip thickness of 0.01 to 0.08 mm, and planted to be 7 to 13 mm high in the toothbrush.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

A toothbrush according to the present invention is comprised of one-end tapered bristles formed of polyester resin to be 13 to 18 mm in total length and 4 to 8 mm in tapered length. To manufacture the toothbrush, the non-tapered portions of the bristles are pushed down into through holes arranged in a planting pattern in a bristle holder. The bottom of the bristle holder is thermally fused to thereby fix the bristles to the bristle holder. The bristle holder is then attached to the head of the toothbrush.

Figure 1A:
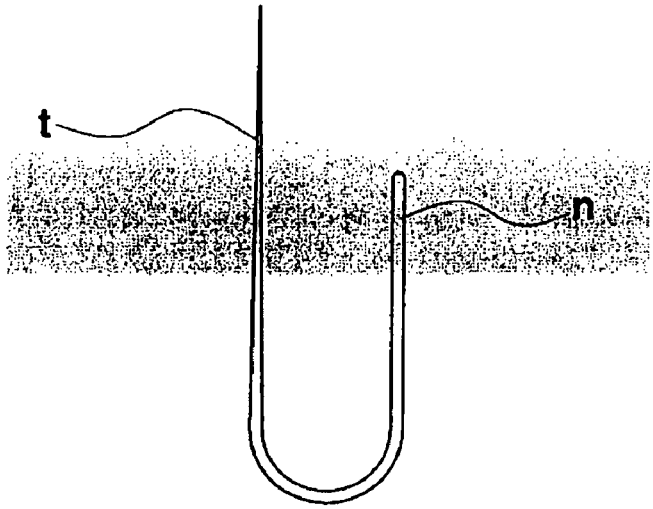
FIG. 1A is a side view of a folded 23 to 33 mm long bristle which is needle-shaped on one end and non-needle-shaped on the other end, before planting.
Figure 1B:
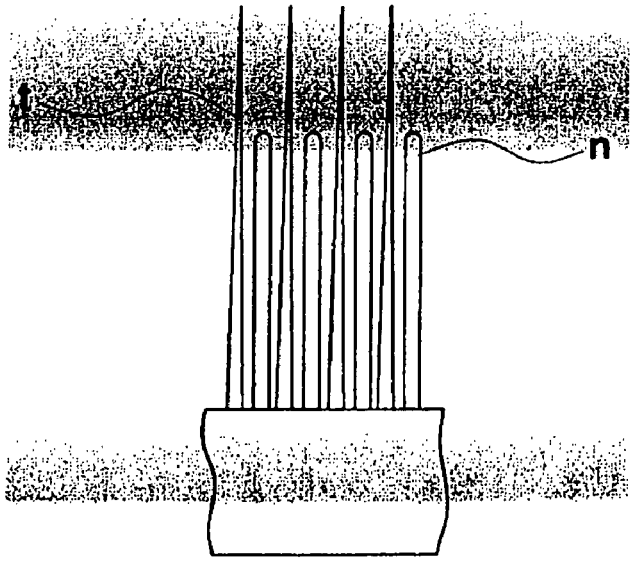
PRIOR ART FIG. 1B
FIG. 1B is a partial enlarged view of bristles as illustrated in FIG. 1A planted in a toothbrush head.
Figure 2:
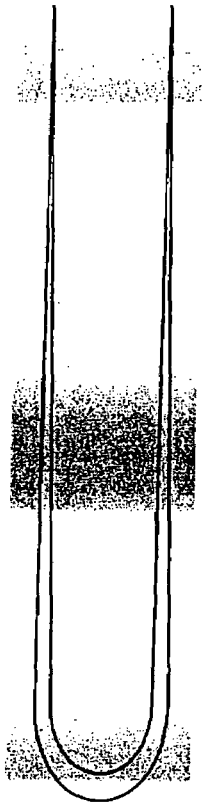
FIG. 2 is a side view of a folded 28 to 33 mm long bristle which is tapered 4 to 8 mm on both ends like needles, before planting.
Figure 3:
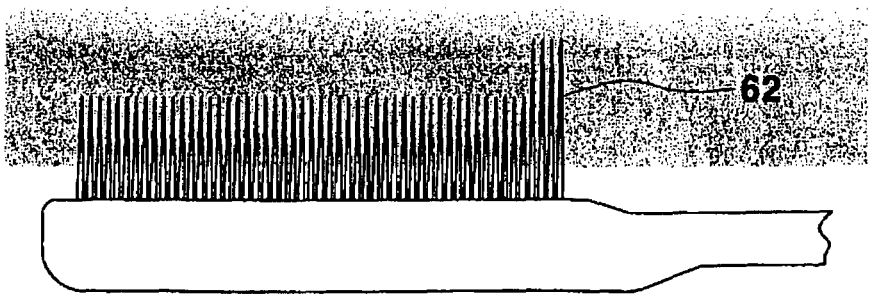
PRIOR ART FIG. 3
FIG. 3 is a schematic view illustrating a toothbrush tufted with ordinary both-end tapered bristles and 1 to 10 mm longer ones.
Figure 4:
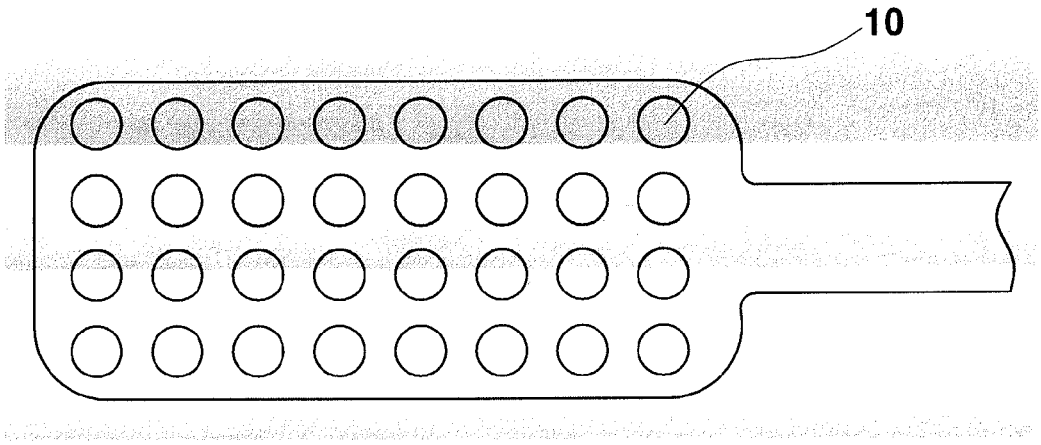
FIG. 4 PRIOR ART
FIG. 4 is a plan view of a traditional bristle planting pattern for a toothbrush.
Figure 5:
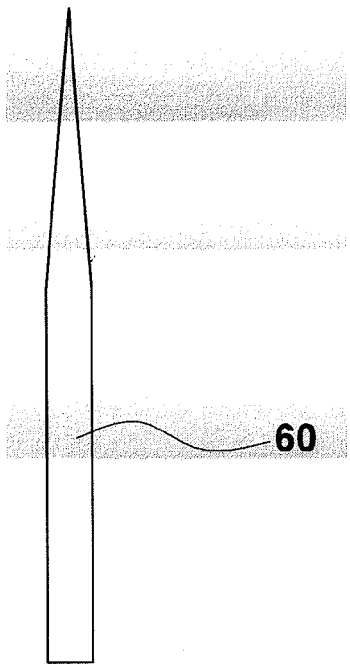
FIG. 5 is a side view of a needle-shaped bristle tapered only on one end according to the present invention.

FIG. 5 is a side view of a single needle-shaped bristle 60 13 to 18 mm in length and 4 to 8 mm in tapered length according to the present invention. As compared to a traditional both-end tapered bristle, the bristle 60 is tapered only on one end and shorter by half i.e., the length of the bristle 60 is ½ of the traditional both end tapered bristle, with the same tapered length. Further, a rate of failure during the process for tapering the bristle, according to an embodiment of the present invention, decreases substantially because only one end is tapered as compared with the traditional bristle in which both ends are tapered.

Since the bristle 60 is planted 5 to 6 mm deep in a toothbrush head, it is then 7 to 13 mm high from the surface of the toothbrush head.

The tapered tip of the bristle 60 is 0.01 to 0.08 mm thick. The tapered tip thickness is preferably 0.01 to 0.03 mm to allow the bristles to reach deep between teeth and into gum pockets, and 0.03 to 0.08 mm for thorough cleansing. Both features can be obtained by planting the two types of bristles in combination, or grinding bristles by means of a mesh paper (i.e. sandpaper) after planting, which will be described later.

It is preferable to form the bristles of polyester resin, specifically PET (Polyethylene Terephthalate) or PBT (Polybuthylene Terephthalate) resin. It is because other materials such as Nylon, acryl, and PP (Polypropylene) resin are inferior in terms of water resistance, durability, and strength, and bristles formed of such a material are entangled when they are immersed in a strong acid or alkaline solution, for tapering. Thus, processing is difficult.

Figure 6:
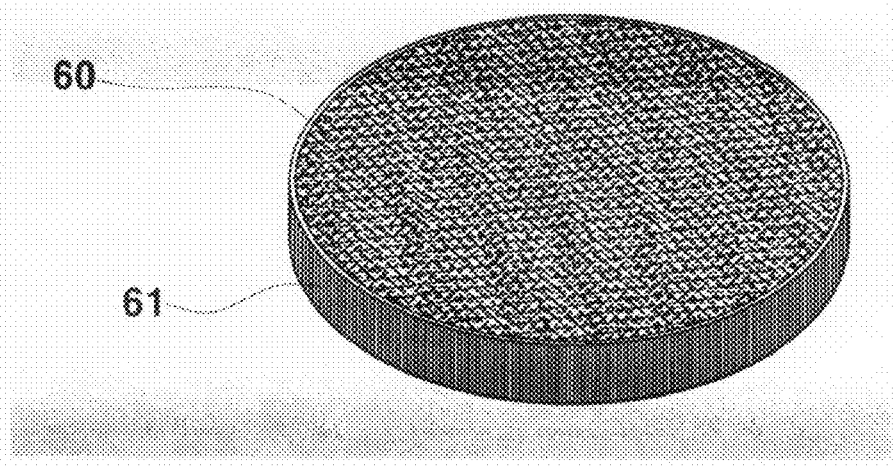
FIG. 6 is a perspective view of needle-shaped bristles as illustrated in FIG. 5 vertically loaded in a cylindrical container.
Figure 7:
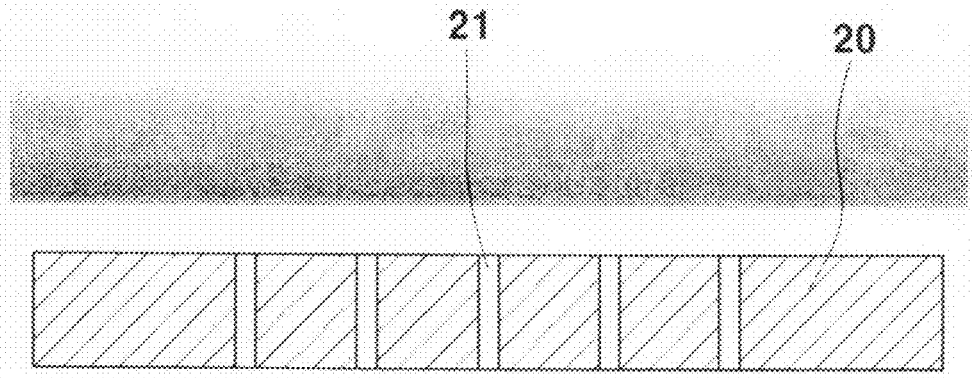
FIG. 7 is a side sectional view of a primary bristle holder for use in manufacturing a toothbrush according to the present invention.
Figure 8:
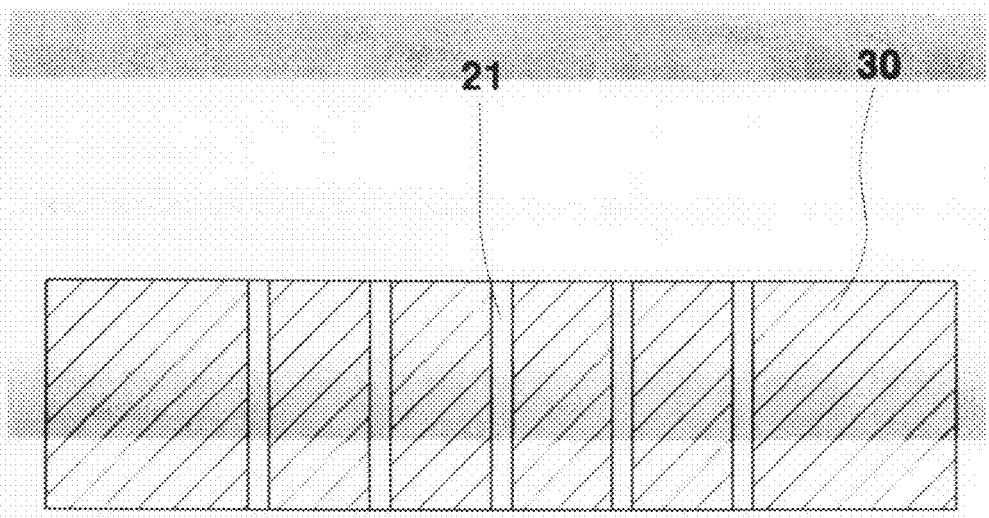
FIG. 8 is a side sectional view of a secondary bristle holder for use in manufacturing the toothbrush according to the present invention.
Figure 9:
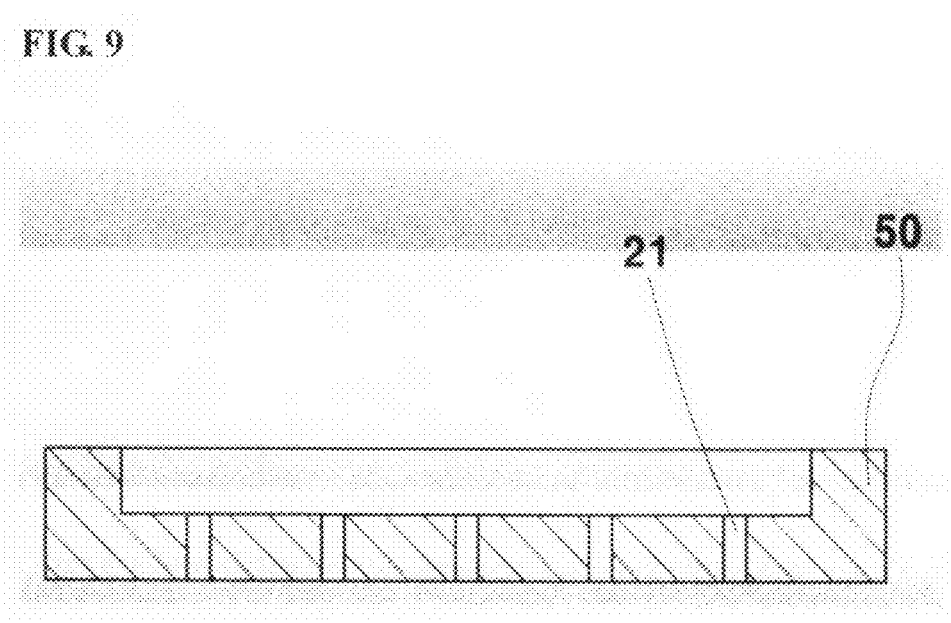
FIG. 9 is a side sectional view of a head insert for use in manufacturing the toothbrush according to the present invention.

FIG. 6 is a view illustrating the bristles 60 loaded vertically in a cylindrical plastic container 61. The loaded bristles 60 are held in a primary bristle holder 20 as illustrated in FIG. 7, transferred to a secondary bristle holder 30 as illustrated in FIG. 8, and then transferred to a head insert 50 as illustrated in FIG. 9. The primary bristle holder 20, the secondary bristle holder 30, and the head insert 50 include through holes 21 of the same shape. The primary and secondary bristle holders 20 and 30 are formed of a metal, whereas the head insert 50 is preferably formed of plastic though a metal can be used.

Since the primary and secondary bristle holders 20 and 30 function to transfer the bristles 60 to the head insert 50, they are of a metal due to its excellent durability. The head insert 50 is formed of plastic because it is attached to a toothbrush body 70, with the bristles 60 planted therein.

Figure 10:
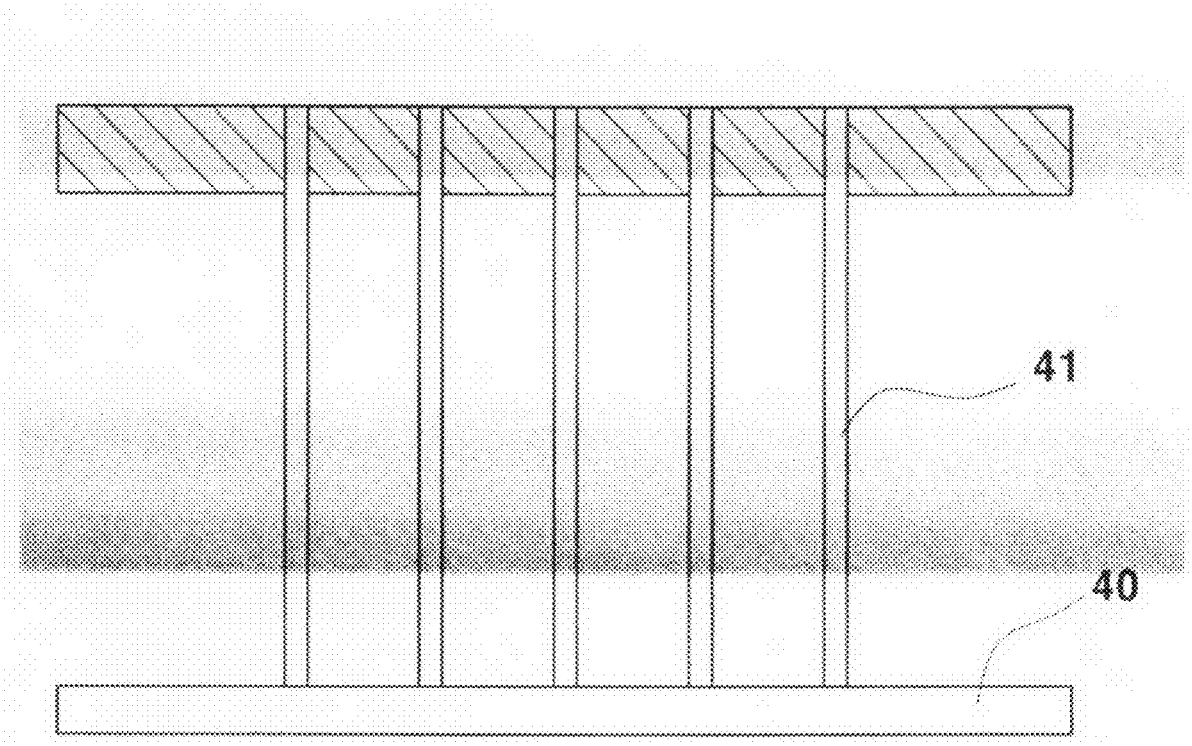
FIG. 10 is a side sectional view of a pusher having inserting poles matching through holes formed in the primary bristle holder.

The bristles 60 are held in the primary bristle holder 20 by pushing the bristles 60 into the primary bristle holder 20 with a pusher 40 having inserting poles 41 matching the through holes 21 of the primary bristle holder 20, as illustrated in FIG. 10.

Figure 11:
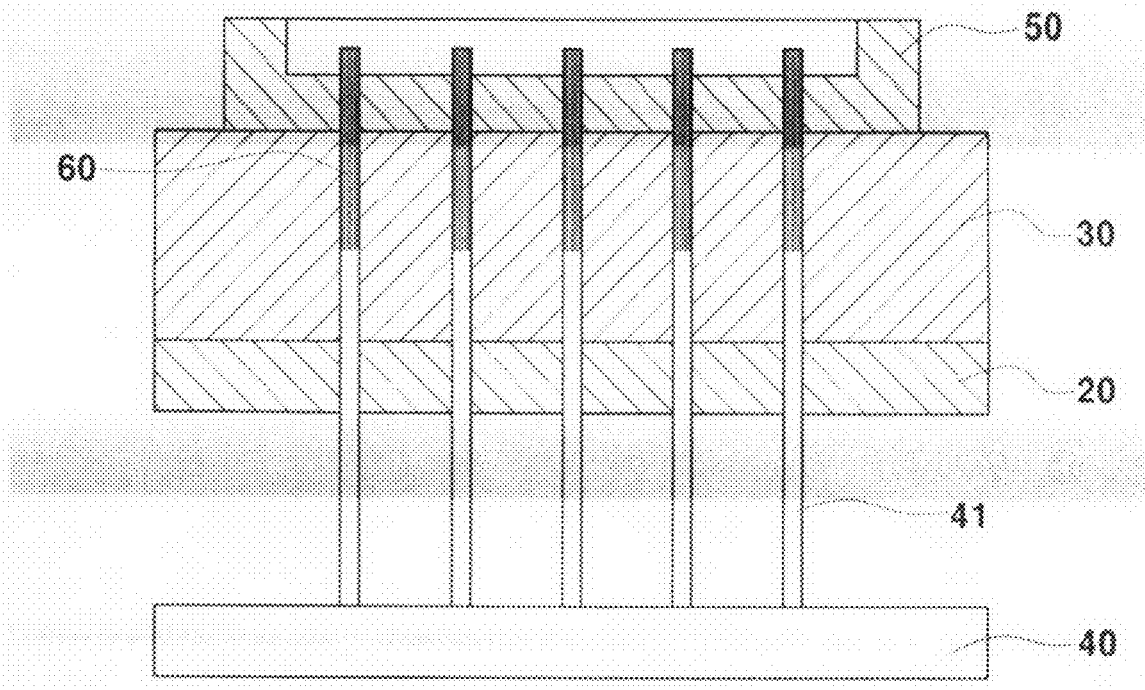
FIG. 11 is a view illustrating transfer of the needle-shaped bristles from the primary bristle holder to the secondary bristle holder and the head insert.

Referring to FIG. 11, the bristles 60 are then transferred from the primary bristle holder 20 to the head insert 50 through the secondary bristle holder 30 by pushing the bristles 60 held in the primary bristle holder 20 to the secondary bristle holder 30 and then the head insert 50 with the pusher 40, while matching the through holes 21, in alignment, of the primary and secondary bristle holders 20 and 30 and the head insert 50. Here, the non-tapered portions n of the bristles 60 are upward.

Figure 12:
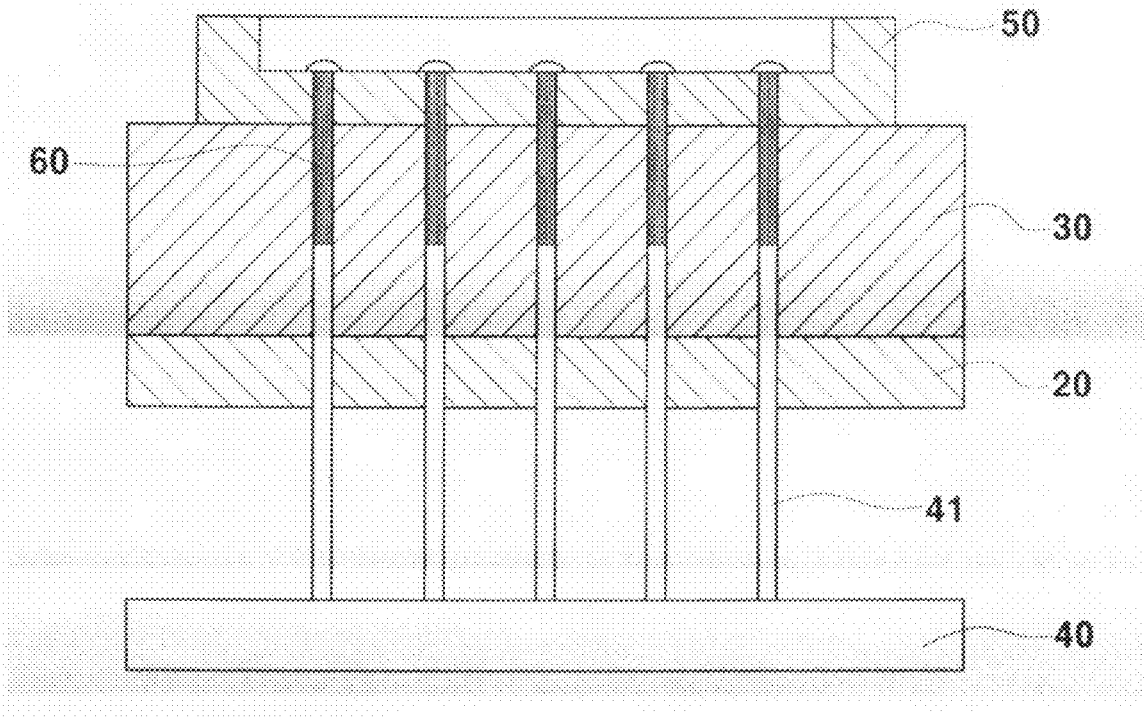
FIG. 12 is a view illustrating thermal fusion of the needle-shaped bristles to the head insert.

Referring to FIG. 12, the bristles 60 protruding from the head insert 50 are thermally fused, thereby being fixed firmly to the head insert 50.

During this process, the length of the bristles 60 is controllable to some extent. That is, short bristles 60 are thermally fused while they are protruded to a short length, for example, 1 mm or less, and long bristles 60, while they are protruded to a long length, for example, about 3 mm. In the case of very long bristles, they are thermally fused in the above manner and then their tips are cut, followed by grinding with a mesh paper. Therefore, an available length range for the one-end tapered bristles 60 is widened.

When the bristles differ in length after planting, the tips of longer ones are cut and ground by a mesh paper. Thus, the length and tip thickness of the bristles are controlled. In this case, bristles having a tip thickness of 0.01 to 0.03 mm coexist with ones having a tip thickness of 0.03 to 0.08 mm. As a result, the bristles reach deeper between teeth and into gum pockets and clean the surfaces of the teeth thoroughly.

To reach deeper into the gum pockets, the bristles can be planted such that they differ in length by 1 to 10 mm. That is, the planting of long bristles and short bristles with a 1 to 10 mm length difference makes the longer ones reach further between teeth or into gum pockets.

The head insert 50 having the bristles 60 fixed thereto is attached to the head of the toothbrush body 70 by an adhesive, ultrasonic bonding or high frequency bonding.

Figure 13:
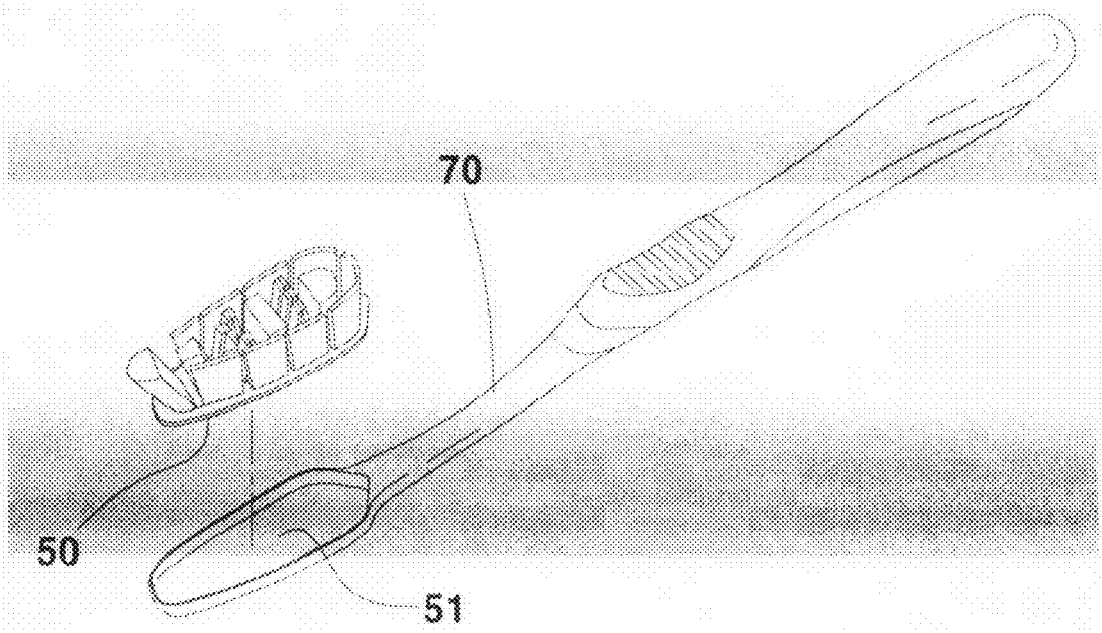
FIG. 13 is a perspective view of a toothbrush handle before the head insert is attached.
Figure 14:
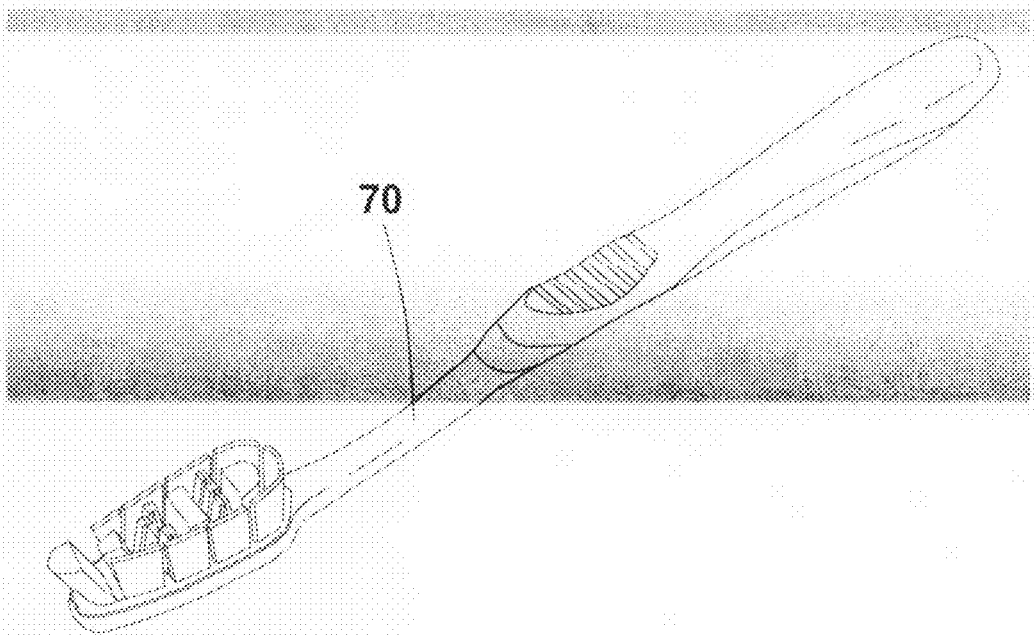
FIG. 14 is a perspective view of the toothbrush tufted with the bristles tapered only one end.

Considering product yield, the ultrasonic or high frequency boding is more preferable. In this case, a head insert opening 51 is preferably formed in the head of the toothbrush body 70, so that the head insert 50 can be mounted in the head insert opening 51, as illustrated in FIG. 13. The thus-completed toothbrush is illustrated in FIG. 14.

Figure 15:
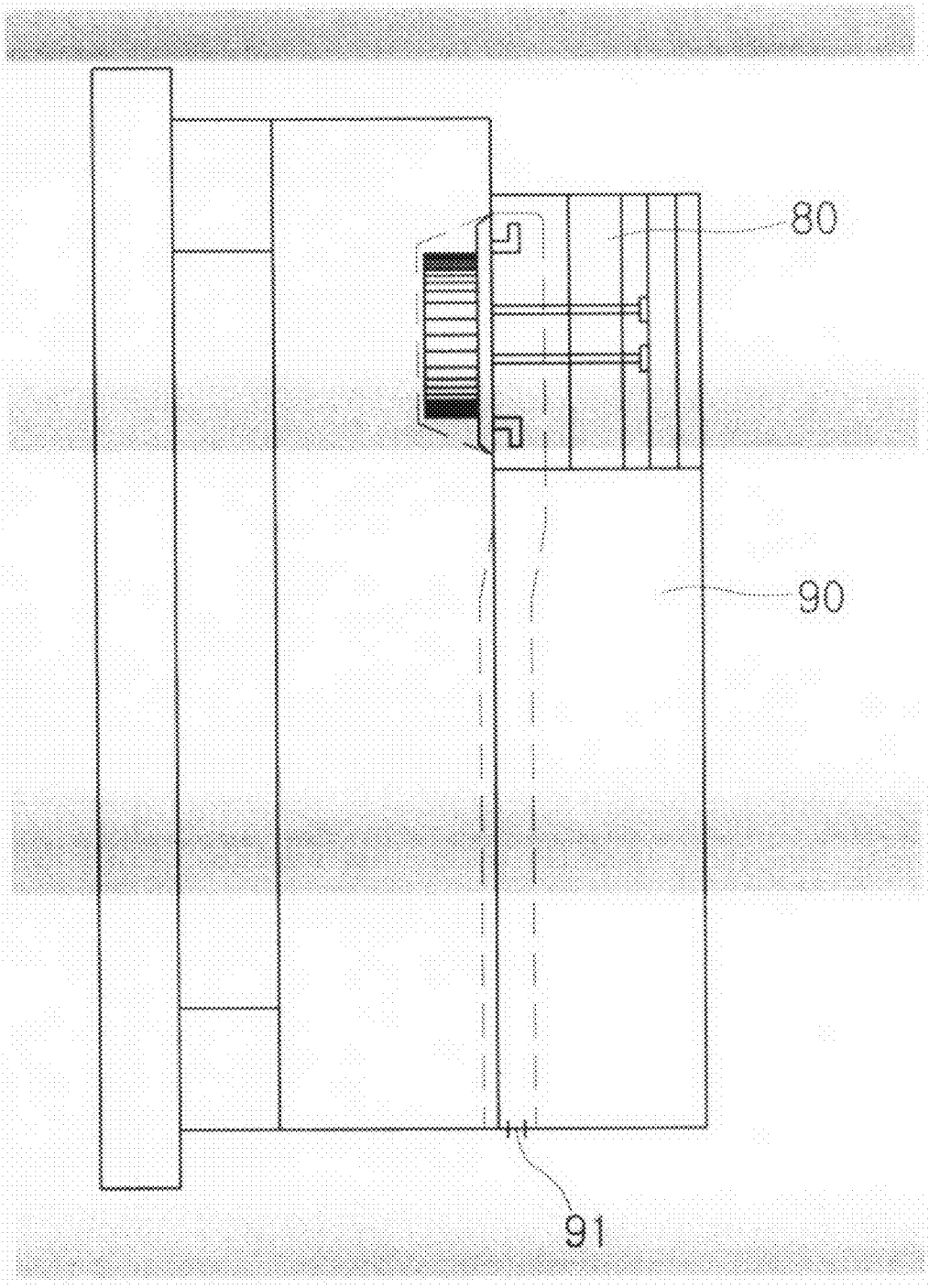
FIG. 15 is a view illustrating attachment of the head insert to the toothbrush handle by injection molding.

An alternative way of fixing the head insert 50 with the bristles 60 to the toothbrush body 70 is, as illustrated in FIG. 15, to combine a lower metal mold 90 to an upper metal mold 80 with the bottom of the head insert 50 fixed to the upper metal mold 80, injecting resin into the lower metal mold 90 through an inlet 91, so that the head and handle of the toothbrush are integrally formed and at the same time, the head insert 50 is tightly combined with the toothbrush head. This fixing method advantageously enables manufacture of various types of toothbrushes using metal molds for the toothbrush head and handle of different shapes, increases process efficiency, prevents introduction of foreign materials due to formation of no junction gaps, and makes it possible to reduce the thickness of the toothbrush head, thus allowing easy thorough teeth brushing.

Figure 16:
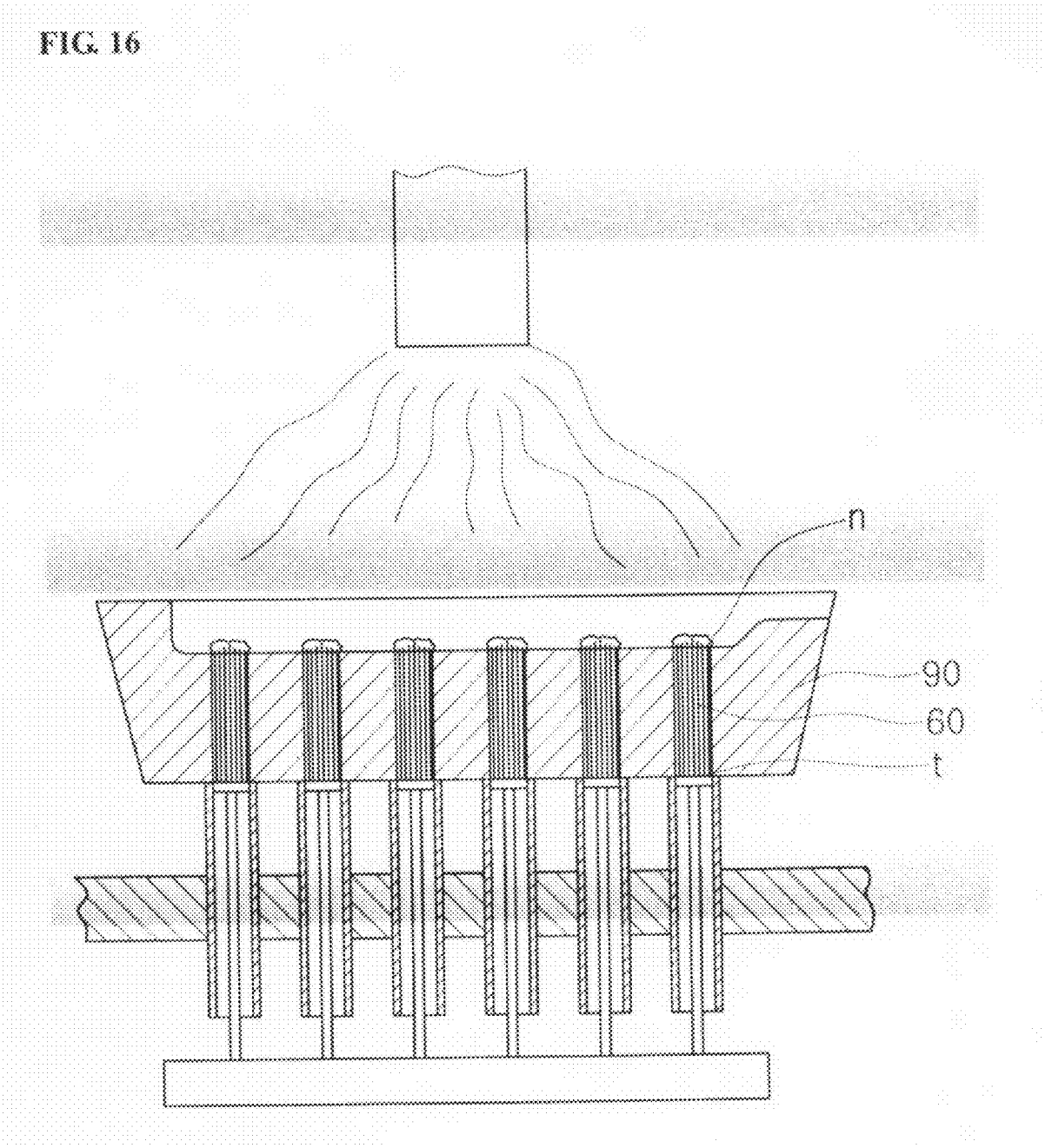
FIG. 16 is a view illustrating partial thermal fusion of the bristles.

Another way of planting the bristles 60 in a toothbrush body is that the non-tapered portions of the bristles 60 are inserted into through holes in the lower metal mold 90, protruding 2 to 5 mm from the metal mold 90, these protrusions are thermally fused, an upper metal mold (not shown) is combined with the lower metal mold 90, and then resin is injected so that the bristles 60 are attached directly to the toothbrush body, as illustrated in FIG. 16. This method also offers the benefits that the toothbrush head is integrated into the toothbrush handle, product yield is increased, no junction gaps are produced to thereby prevent introduction of foreign materials, and reduces the thickness of the toothbrush head.

As described above, the toothbrush according to the present invention is tufted with needle-shaped bristles tapered only on one end, as compared to the traditional toothbrush having both-end tapered bristles. Therefore, an inferior goods rate is remarkably dropped and thus product cost can be reduced by 30% or more.

Furthermore, a bristle planting pattern and the number of the needle-shaped bristles can be freely controlled, thereby enabling the bristles to clean away hard-to-reach plague. The use of thermal fusion instead of a cut wire leads to tighter fixing of the bristles. Even needle-shaped bristles which are failed in length control can be utilized for fabrication of the toothbrush.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A method of manufacturing a toothbrush, comprising the steps of:

inserting a plurality of bristles into each of a plurality of through holes defined between an upper surface and a lower surface of a head insert, said lower surface being near to a bottom of the head insert, each of said bristles defining a non-tapered portion at a first end and a tapered portion at a second end opposite to the first end thereof, said non-tapered portion being received into the through hole; and maintaining the tapered portions of the bristles outside and away from the upper surface of the head insert and the non-tapered portion of the bristles to protrude from the lower surface of the head insert;

thermally fusing the non-tapered portion of the bristles protruding from the lower surface of the head insert, thereby fixing the bristles to the head insert;

attaching the bottom of the head insert to an upper metal mold;

combining the upper metal mold with a lower metal mold; and injecting resin into the lower metal mold through an inlet, thereby attaching the head insert to a head of the toothbrush.

2. The method of claim 1, wherein a length of the tapered portions of the bristles is 4-8 mm.

3. A method of manufacturing a toothbrush, comprising the steps of:

inserting a plurality of bristles into each of a plurality of through holes defined between a top part and a bottom part of a lower metal mold, each of said bristles defining a non-tapered portion at a first end and a tapered portion at a second end opposite to the first end, said non-tapered portion being received into the through hole to protrude 2 to 5mm from the bottom part of the lower metal mold; and maintaining the tapered portion of the bristles outside and away from the top part of the lower metal mold;

thermally fusing the protruded non-tapered portion of the bristles;

combining an upper metal mold with the lower metal mold; and injecting resin into the upper and lower metal molds, thereby fixing the bristles directly to a head of the toothbrush.

4. The method of claim 3, wherein a length of the tapered portions of the bristles is 4-8 mm.

* * * * *